US009140021B2

(12) United States Patent
Ljungström et al.

(10) Patent No.: US 9,140,021 B2
(45) Date of Patent: Sep. 22, 2015

(54) ADHESIVE SPREADER

(71) Applicant: MCFL Trading Handelsbolag, Malmö (SE)

(72) Inventors: Fredrik Ljungström, Malmö (SE); Marcus Clauson, Hjärup (SE)

(73) Assignee: MCFL Trading Handelsbolag, Tygelsjo (SE)

( * ) Notice: Subject to any disclaimer, the term of this patent is extended or adjusted under 35 U.S.C. 154(b) by 0 days.

(21) Appl. No.: 14/273,829

(22) Filed: May 9, 2014

(65) Prior Publication Data

US 2014/0331432 A1 Nov. 13, 2014

(30) Foreign Application Priority Data

May 10, 2013 (SE) ..... 1350580

(51) Int. Cl.

| | |
|---|---|
| ***B05C 17/10*** | (2006.01) |
| ***E04F 21/16*** | (2006.01) |
| ***E04F 21/02*** | (2006.01) |

(52) U.S. Cl.

CPC ..... *E04F 21/023* (2013.01); *B05C 17/10* (2013.01); *E04F 21/02* (2013.01); *E04F 21/162* (2013.01)

(58) Field of Classification Search

USPC ..... 15/235.4–235.6, 236.01, 15/236.05–236.09, 245.1; 118/100, 200, 118/256, 413; D8/45

See application file for complete search history.

(56) References Cited

U.S. PATENT DOCUMENTS

| | | | | | |
|---|---|---|---|---|---|
| 2,008,952 | A | * | 7/1935 | Gach | 15/245.1 |
| 2,081,735 | A | * | 5/1937 | Caronia | 15/245.1 |
| 2,806,240 | A | | 9/1957 | Cottar | |
| 2,913,753 | A | * | 11/1959 | Peterson | 15/245.1 |
| 3,119,138 | A | * | 1/1964 | Davis | 15/245.1 |
| 3,530,777 | A | * | 9/1970 | Peck | 15/235.4 |
| 5,606,763 | A | * | 3/1997 | South et al. | 15/245.1 |
| 5,830,534 | A | * | 11/1998 | Dillon | 427/277 |
| 6,308,370 | B1 | | 10/2001 | Southby | |

FOREIGN PATENT DOCUMENTS

| | | |
|---|---|---|
| CA | 2081746 | 4/1994 |
| DE | 202006010821 | 10/2006 |
| FR | 2881449 | 8/2006 |
| JP | 2004160268 | 6/2004 |
| JP | 2012197633 | 10/2012 |

OTHER PUBLICATIONS

Extended European Search Report for counterpart EP Application No. 14167721.1, dated Nov. 5, 2014.

Official Action from corresponding Swedish Application 1350580-5, mailed Dec. 5, 2013.

* cited by examiner

*Primary Examiner* — Mark Spisich

(74) *Attorney, Agent, or Firm* — Renner, Otto, Boisselle & Sklar, LLP

(57) ABSTRACT

A tool for distributing adhesive material on a flat surface, comprising two opposite side portions and a comb portion connecting said side portions, said side sections defining together with said comb portion on three sides a U-shaped open space for receiving adhesive material, and said comb portion having teeth and intermediate indentations. At least one of said side portions comprises at least one oblique section that is inclined towards an opposite side portion.

11 Claims, 2 Drawing Sheets

ADHESIVE SPREADER

TECHNICAL FIELD

The present invention relates to a tool for use in spreading an adhesive material on a flat surface and particularly to tile trowels or spreaders used to apply adhesive or mortar for tiles, such as ceramic tiles and/or clinker slabs.

PRIOR ART

When ceramic tiles and/or clinker slabs are laid there is normally used an adhesive or self-levelling adhesive mortar comprising a highly viscous substance that is applied to the flat surface that eventually will be covered with the tiles. After laying the tiles the adhesive is hardened and the tiles are fixed to the adhesive.

The laying of tiles normally is performed by a tradesperson distributing an even height of adhesive on a section of the surface upon which the tiles are to be laid (generally a floor). Then tiles are laid on the adhesive material and more adhesive material is distributed on a further section of the surface. It is normally advantageous to lay the tiles step by step. First of all there is a desire to lay tiles without stepping into the distributed adhesive material and secondly the tiles have to be laid before the adhesive is hardened.

When the mortar is applied a so called tile trowel can be used. It comprises a notched metal blade that is provided with a handle. When the tradesperson has applied an amount of the mortar on the surface upon which the tiles are to be laid the tile trowel is combed over the mortar while being pressed towards the surface. As a result the tile trowel spreads the mortar at an even height and ridges or strings are produced in the mortar. The ridges will improve the adhesion between the mortar and the tile.

When such a tile trowel is used there is much load on the tradesperson who usually has to work in a bent down position to be able to distribute the mortar evenly. When tiles are laid on larger areas further problems will arise relating to inconsistently applied mortar.

A more developed spreader or tile trowel is disclosed in U.S. Pat. No. 6,308,370. That tile trowel comprises a comb portion and two flange portions extending from it in perpendicular directions. The comb portion has a plurality of indentations along a bottom longitudinal edge. A space defined by said comb portion and said flange portions can hold a manageable volume of adhesive. Said flange portions are provided with handles. The handles are used when the tile trowel is combed to distribute the adhesive on a surface. On the outside of each of the flange portions there is provided a gauge surface that will engage and be guided by a guide arranged on tiles laid.

SUMMARY OF THE INVENTION

The present invention is directed to solve problems and drawbacks of prior art devices by a tile trowel which is formed to facilitate and to maintain a continuous movement during the laying of tiles, also along tiles already laid without any need for any additional means for guiding the tile trowel. Preferably at least one side portion extending from a comb portion is provided with or formed with an oblique section. Further embodiments are indicated in sub claims below.

BRIEF DESCRIPTION OF THE DRAWINGS

In order that the manner in which the above recited and other advantages and objects of the invention are obtained will be readily understood, a more particular description of the invention briefly described above will be rendered by reference to specific embodiments thereof which are illustrated in the appended drawings.

Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
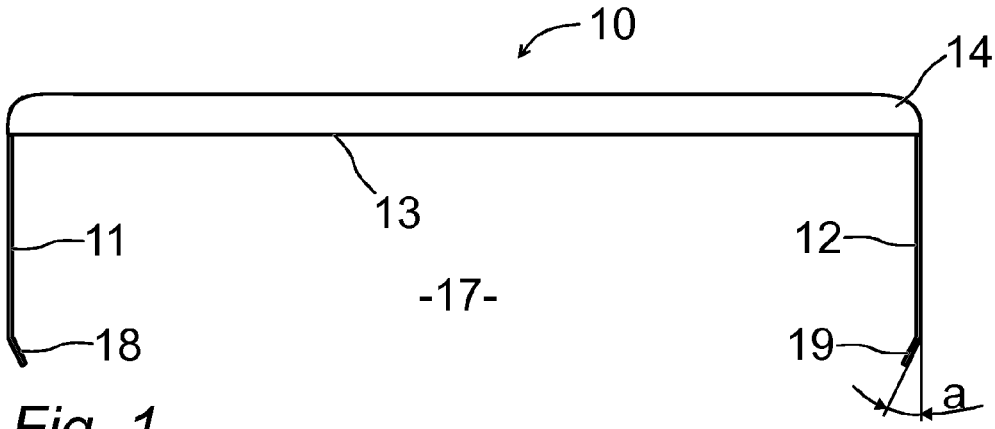
FIG. 1 is a schematic top view of a first embodiment of a tool in accordance with the invention.

With reference to FIG. 1 a tool 10 is shown for spreading an adhesive, such as mortar or self-levelling adhesive mortar, on a flat surface. The tool 10 comprises two side portions 11, 12 and a comb portion 13 connecting said side portions 11, 12. Said comb portion 13 forms a rectangular surface, the shorter side edges thereof being connected to shorter side edges of each of said side portions 11, 12. Said side portions 11, 12 and said comb portion 13 together define an open space 17 capable of receiving a manageable volume of adhesive. Each of said side portions 11, 12 ends with a free edge. The length of each side portion 11, 12 may vary and preferably is determined together with a length of said comb portion 13 so as to define an open space suitable to allow a manageable volume therein.

Said tool 10 also comprises a handle 14 extending in parallel with said comb portion 13 to facilitate the use of the tool 10. Said handle 14 can be connected to each of said side portions 11, 12 and/or to the comb portion 13. In various embodiments the handle 14 can be a section bent in a perpendicular direction from the rectangular surface of the comb portion 13. In the embodiment shown in the drawings the handle 14 extends along the full length of the comb section 13. The shape and material of the handle 14 will allow the tradesperson work with and hold the tool 10 with ease. In the embodiment of the tool 10 shown in the drawings the handle 14 is formed with rounded corners.

Figure 2:
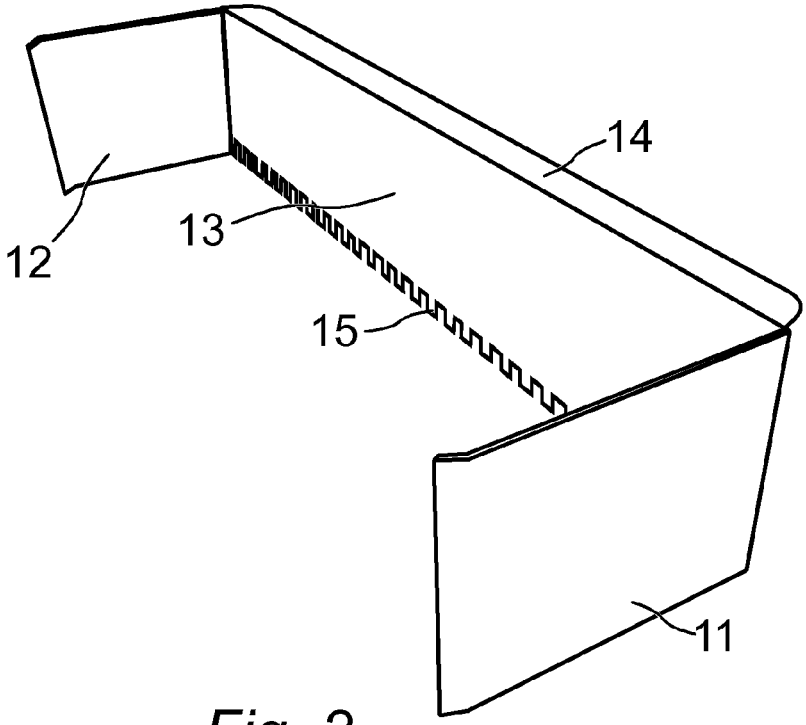
FIG. 2 is a schematic perspective view of the tool of FIG. 1.
Figure 3:
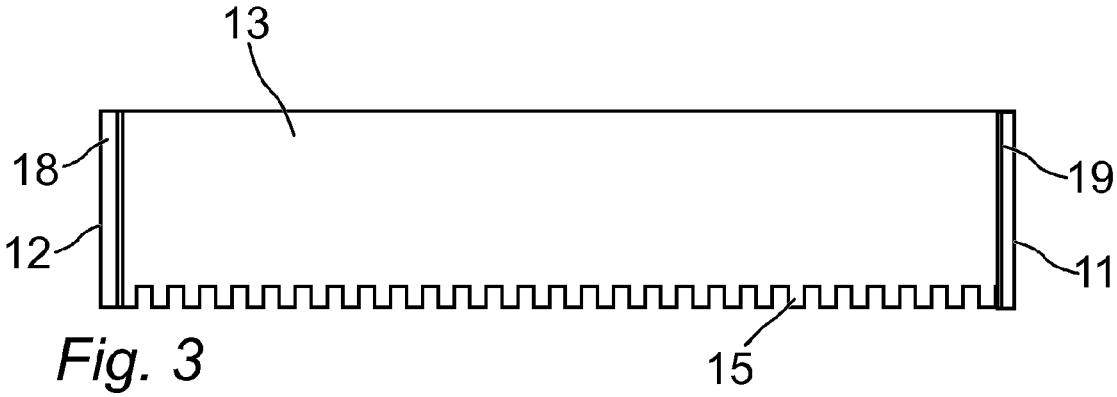
FIG. 3 is a schematic front view of the tool of FIG. 1.

In the embodiment of the tool 10 shown in FIG. 1-FIG. 3 said side portions 11, 12 comprise oblique sections 18, 19 that are bent or inclined towards each other at the ends. In various embodiments only one of said side portions 11, 12 is formed in this way. Said bent or inclined sections 18, 19 will minimize the chances that a side portion 11, 12 will get caught in tiles when the tool 10 is moved along a set of tiles laid, c.f. the description below with reference to FIG. 5. The angle a of inclination of said bent sections 18, 19 from the side portions can be small, such as a few degrees. Said angle also can be in the interval of 5°-80°.

In the embodiment shown in FIG. 1-FIG. 3 the oblique sections 18, 19 constitute bent extensions of said side portions 11, 12. As a result a rounded outer shape is formed that will ensure that a side portion 11, 12 engaging a row of tiles laid will not get caught. The length of the oblique sections 18, 19 also is sufficient to guarantee the desired function. Still, a substantial part of said side portions 11, 12 will engage a row of tiles laid without getting caught. The part of a side portion 11, 12 engaging tiles will facilitate and improve the guiding of the tool 10, so as to spread the adhesive in a strip at a correct position. In various embodiments a transition section between said side portion and said oblique portion is formed with a rounded outer shape to ensure that the tool 10 will not get caught on tiles laid.

FIG. 2 and FIG. 3 show the comb portion 13 in more detail. A bottom longitudinal side edge, that is the side edge that engages the surface, has a plurality of teeth 15 with intermediate indentations. The teeth 15 (and indentations) can be rectangular, triangular, V-shaped or U-shaped depending on different applications and different types of mortar, bottom surface and tiles.

Figure 4:
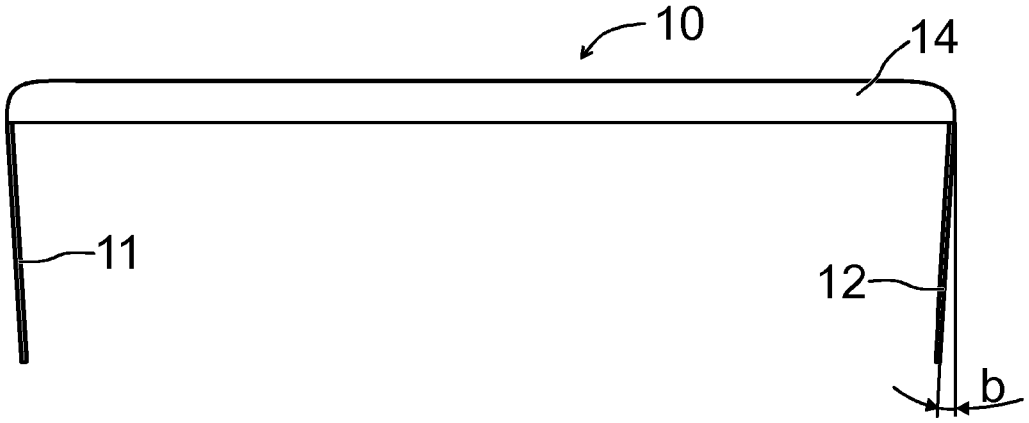
FIG. 4 is a schematic top view of a second embodiment of a tool in accordance with the invention.

A further embodiment of the tool 10 is shown in FIG. 4. Each side portion 11, 12 is flat but extending from the comb portion 13 at an angle b towards each other. The angle b would only be a few degrees, such as 3-20°. This embodiment also will ensure that the tool 10 does not get caught in tiles laid. It should also be noted that at least a section of a side portion 11, 12 still will engage a row of tiles laid. As a result the tool 10 will be guided to facilitate the spreading of adhesive material.

The upper sides of the comb portion 13 and the side portions 11, 12, or the handle 14, can be provided with a moulding, such as a rubber moulding, for minimizing injuries and for facilitating the handling of the tool 10. In various embodiments the tool 10 is provided also with handles and other means suitable for gripping.

In various embodiments said side portions 11, 12 and said comb portion 13 are formed by one single sheet of metal, such as stainless steel, which is bent to a suitable shape. As a result said tool 10 is readily cleaned after use. The width of the tool 10 preferably is adapted to the size of the tiles and to the area that will be covered with tiles and can be about 600 mm, which is a size that can be used for different tiles of standard sizes. The size of the tool 10 can also be smaller for instance when smaller floor areas are to be covered.

Figure 5:
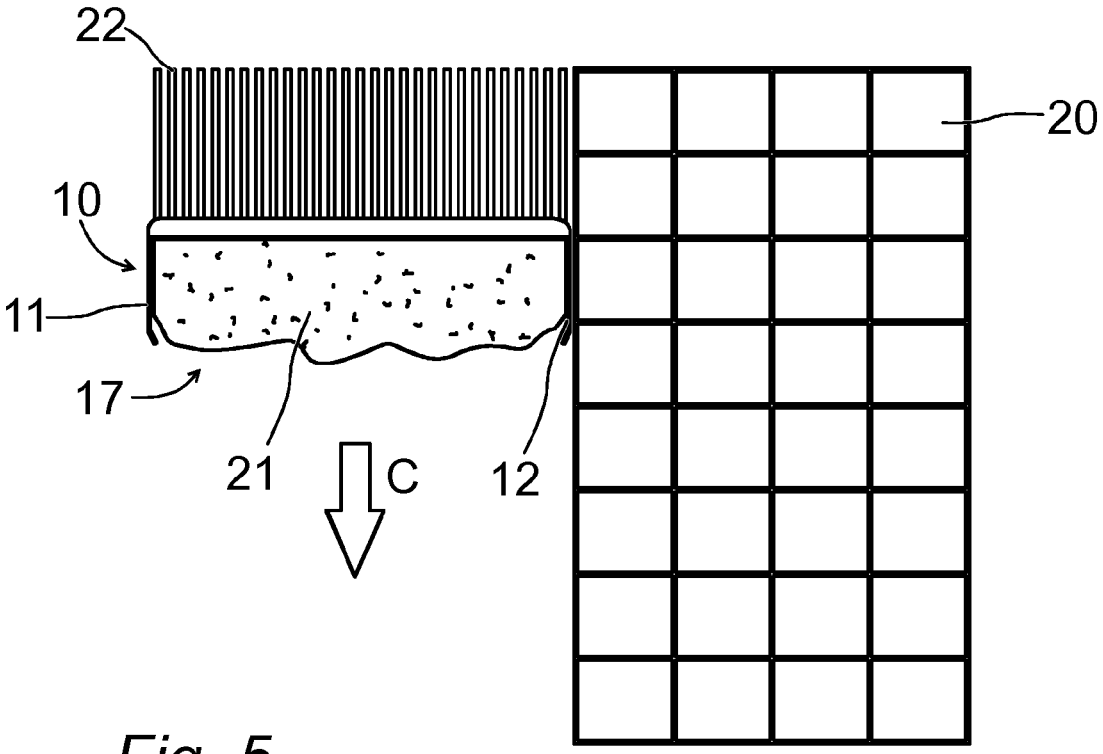
FIG. 5 is a schematic top view illustrating how the tool is operated at a section of tiles laid.

FIG. 5 illustrates the use of the tool 10. At use the tool 10 preferably is placed close to a corner of the surface that will be covered with tiles. The open space 17 then is filled with adhesive or mortar. When the tool 10 is moved the adhesive or mortar in the open space 17 will pass through the indentations between the teeth 15 of the comb portion 13 and will be evenly distributed over the surface.

As shown in FIG. 5 four tiles have been laid side by side in a plurality of rows. Then adhesive material or mortar has been filled into the space 17 and the tool 10 has been moved a distance in the direction of arrow C. Some amount of the adhesive material or mortar then has been left on the surface in strings or ridges 22. During a continued movement in the direction of arrow C one side portion 12 will abut an outer line of tiles 20. During such movement the tool 10 is guided efficiently and the adhesive material will be positioned correctly. The movement in the direction of arrow C will continue until a desired length of adhesive material is completed. It can be necessary to provide more adhesive material as time goes by.

While certain illustrative embodiments of the invention have been described in particularity, it will be understood that various other modifications will be readily apparent to those skilled in the art without departing from the scope and spirit of the invention. Accordingly, it is not intended that the scope of the claims appended hereto be limited to the description set forth herein but rather that the claims be construed as encompassing all equivalents of the present invention which are apparent to those skilled in the art to which the invention pertains.

The invention claimed is:

1. A tool for distributing adhesive material on a flat surface, comprising a comb portion and two opposite side portions connected to and extending from opposite ends of said comb portion, said side portions defining together with said comb portion on three sides a U-shaped open space for receiving adhesive material, wherein edges of said side portions and an edge of said comb portion that will engage said flat surface extend in one plane and wherein said side portions and said comb portion extend perpendicular to said plane, and said comb portion having teeth and intermediate indentations, wherein at least one of said side portions comprises at a free end at least one oblique section that is inclined towards an opposite side portion.

2. The tool as claimed in claim 1, wherein said indentations are rectangular, triangular, V-shaped or U-shaped.

3. The tool as claimed in claim 1 comprising at least one handle.

4. The tool as claimed in claim 1, wherein said side portions and said comb portion are made in one piece.

5. The tool as claimed in claim 4, wherein said side portions and said comb portion are formed by a piece of bent metal sheet.

6. The tool as claimed in claim 1, wherein the length of said comb portion is about 600 mm.

7. The tool as claimed in claim 1, wherein a first side edge of said comb portion is provided with said teeth and indentations and a second side of said comb portion opposite to said first side edge is provided with a rubber moulding.

8. The tool as claimed in claim 1, wherein said oblique section is formed by a section bent from said side portion.

9. The tool as claimed in claim 1, wherein said oblique section forms an angle a to said side portion, said angle a being less than 80°.

10. The tool as claimed in claim 1, wherein a transition section between said side portion and said oblique section is formed with a round outer shape.

11. The tool as claimed in claim 1, wherein said free end is distal said comb section and a portion of said at least one of said side portions located proximate said comb section extends parallel to at least a portion of the opposite side portion in a direction extending parallel to said plane.

* * * * *